United States Patent [19]

Baumeister

[11] Patent Number: 4,511,244

[45] Date of Patent: Apr. 16, 1985

[54] CORONA GENERATING APPARATUS AND METHOD

[75] Inventor: Hans P. Baumeister, Churchville, N.Y.

[73] Assignee: Eastman Kodak Company, Rochester, N.Y.

[21] Appl. No.: 529,444

[22] Filed: Sep. 6, 1983

[51] Int. Cl.[3] ..... G03G 15/00

[52] U.S. Cl. ..... 355/14 FU; 355/3 CH; 355/14 CH; 355/3 FU; 250/324; 219/216; 323/235

[58] Field of Search ..... 355/3 CH, 14 CH, 3 FU, 355/14 FU; 323/235; 328/144; 219/216; 250/324, 325, 326

[56] References Cited

U.S. PATENT DOCUMENTS

| | | | |
|---|---|---|---|
| 2,588,699 | 3/1952 | Carlson | 118/621 |
| 3,160,746 | 12/1964 | Clark | 118/621 |
| 3,496,352 | 2/1970 | Jugle | 250/324 |
| 3,871,761 | 3/1975 | Mabrouk | 355/14 FU X |
| 4,113,375 | 9/1978 | Murata et al. | 355/14 FU |
| 4,303,334 | 12/1981 | Haupt et al. | 355/14 FU X |
| 4,324,486 | 4/1982 | Nishikawa | 355/14 FU |
| 4,435,677 | 3/1984 | Thomas | 323/235 |

OTHER PUBLICATIONS

Research Disclosure, p. 119, Publication #20321, Entitled *Cleaning Corona Wires,* Mar. 1981.

*Primary Examiner*—A. C. Prescott
*Attorney, Agent, or Firm*—Norman Rushefsky

[57] ABSTRACT

A coronode for use in an electrophotographic apparatus has one end thereof coupled to a high electrical potential output of an electrical transformer for use in generating a corona discharge current. A tap from another terminal of the transformer is coupled to another end of the coronode to establish a small EMF between the ends of the wire that is used in resistance heating of the coronode.

8 Claims, 3 Drawing Figures

CORONA GENERATING APPARATUS AND METHOD

BACKGROUND OF THE INVENTION

1. Field of the Invention

This invention relates to electrophotography and particularly to improved corona generating apparatus for applying an electrostatic charge onto a recipient surface.

2. Description of the Prior Art

In known electrophotographic reproduction apparatus such as copiers or duplicators, an electrostatic charge is deposited on an area of a photoconductor as the area is moved past a corona current generating station. The photoconductor is then moved to an exposure station where the area is exposed to image-forming radiation to form a latent electrostatic image of a document to be copied. The latent image is thereafter developed and in the case of plain-paper copiers and duplicators subsequently transferred to a paper, upon which the copied image is to appear. Thereafter, the photoconductor is cleaned and otherwise made ready for the next copy cycle.

In such apparatus, it is important to impart a generally uniform charge over the area upon which the latent image is to be formed. Too low a charge in portions of the area may result in weak, washed-out looking areas on copies, and too great a charge in portions of the area may result in areas on copies being too dark relative to other areas. Therefore, copy quality, particularly with pictorial subject matter, is affected seriously where a non-uniform charge is placed on the photoconductor.

In the apparatus referred to above, development of the latent image is effected with electrostatically charged powder-like particles known as toner that are brought into surface contact with the photoconductor and are held thereon electrostatically in a pattern corresponding to the latent electrostatic image. Because of the fine nature of the toner and rapid movement of the photoconductor, particles of toner tend to become entrained in air currents within the apparatus and are carried to unwanted areas of the apparatus including the corona generating station.

The deposition of toner particles on a coronode wire of a corona generating station has a deleterious effect on the charging efficiency and charging uniformity of the coronode. In U.S. Pat. No. 3,496,352, a self-cleaning corona generating apparatus is disclosed which includes a high voltage power supply that is connected to a coronode or corona current generating electrode for generating a corona current. Also connected to the coronode is a coil comprising the secondary of a second power supply which may be selectively enabled to heat the coronode to vaporize toner particles depositing on the wire. An undesirable feature of this solution is the requirement of multiple power supplies each needed to accomplish a specific function. The reduction in the number of parts comprising electrophotographic reproduction apparatus comprises a continuing objective of manufacturers in their attempt to make these apparatus smaller and less expensive. The invention is therefore directed to the problem of heating of a corona generating electrode employing fewer parts than known apparatus of the prior art.

SUMMARY OF THE INVENTION

The invention is directed to a corona generating apparatus that includes a corona current generating electrode that is coupled to a high voltage terminal of a transformer. The electrode is also coupled to an intermediate tap on the transformer to establish a small EMF (electromotive force) between the terminals of the electrode for generating a current through the electrode.

The invention is further directed to an electrophotographic method and apparatus wherein an electrostatic charge is deposited on a photoconductive member during a reproduction mode by an electrode which is heated with a non-corona generating current that is established in the electrode simultaneously with the generation by the electrode of the corona current.

DESCRIPTION OF THE DRAWINGS

In the detailed description of the preferred embodiment of the invention presented below, reference is made to the accompanying drawings, in which.

DESCRIPTION OF THE PREFERRED EMBODIMENT

Because apparatus of the type described herein are well known, the present description will be directed in particular to elements forming part of or cooperating more directly with the present invention.

Figure 1:
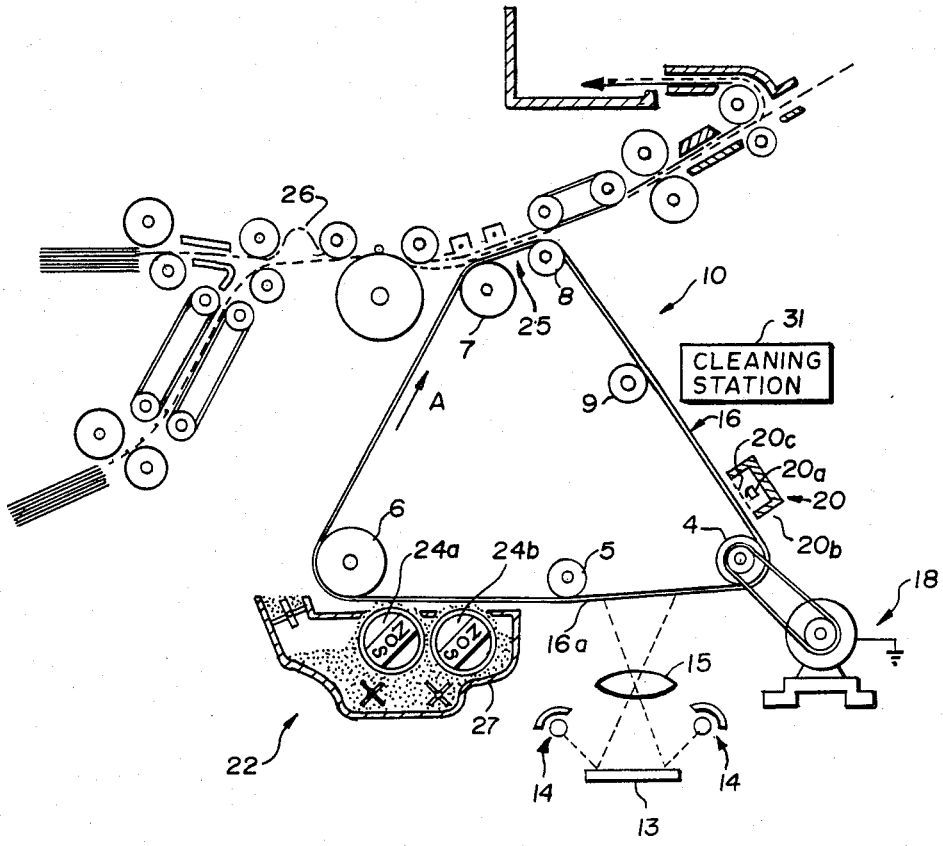
FIG. 1 is a side elevational view in schematic form of a copier which incorporates apparatus in accordance with the invention.

For a general understanding of an electrographic copier/duplicator apparatus 10 wherein the invention has utility, reference is made to FIG. 1. As shown, a photoconductor member, in the form of a photoconductive web 16, is trained about rollers 4 through 9 for movement in the direction indicated by the arrow A. Roller 9 is driven by a drive mechanism 18 shown for simplicity to include a motor-pulley arrangement. An insulating layer 16*a* of the web 16 is charged at a corona charge station (charger) 20. The charger 20 includes one or more corona current generating electrodes 20*a*, a shield 20*b*, a grid 20*c* and will be described more fully in connection with FIG. 2. Thereafter and at an appropriate time during a reproduction mode of the electrophotographic apparatus, an information medium 13 such as a document to be copied, is illuminated at an image exposure station by radiation from flash lamps 14. Such radiation is reflected from the medium and projected by a lens 15 onto the charged insulating surface 16*a* of the web 16, to selectively dissipate charge and form an electrostatic latent image of medium 13 on a specific area of the web. For more specific disclosures of the web, see commonly assigned U.S. Pat. Nos. 3,615,406 and 3,615,414, both issued Oct. 26, 1971.

The apparatus 10 further includes a development station 22 at which the moving electrostatic image is contacted with finely divided charged toner particles that adhere to the charged web surface in a configuration defined by the electrostatic image, to form a visible toner image; a transfer station 25 in which the toner image is transferred to a receiving surface of a copy sheet 26 on which it can be subsequently permanently fused; and a cleaning station 31 in which residual toner particles are removed from the web 16.

At the development station an electrostatic image on the insulating surface 16*a* of web 16 is moved past magnetic brushes 24*a* and 24*b* mounted in a housing 27 of the development station 22. The housing 27 holds a supply of developer containing a mixture of toner and magnetic carrier particles. The brushes 24*a* and 24*b* can be constructed according to any one of a variety of designs known in the prior art. One such design is shown in commonly assigned U.S. Pat. No. 3,543,720 issued Dec. 1, 1970, in the names of Drexler et al. For a specific example of such a developer, see commonly assigned U.S. Pat. No. 3,893,935, issued July 8, 1975 to Jadwin et al. For a more complete description of the general organization of a similar copier apparatus, reference may be made to commonly assigned U.S. Pat. No. 4,025,186, issued May 24, 1977 to Hunt et al.

Although a web-type copier/duplicator has been shown, it will be understood that the present invention is also particularly suitable with copier/duplicator (or printer) apparatus that use drums and also sheet film photoconductors. In any case, it will be understood by those skilled in the art that a microcomputer having a stored program can be effectively used as the logic and control apparatus to control the operation of the copier/duplicator. One such microcomputer is disclosed in the above-referenced U.S. Pat. No. 4,025,186.

Figure 2:
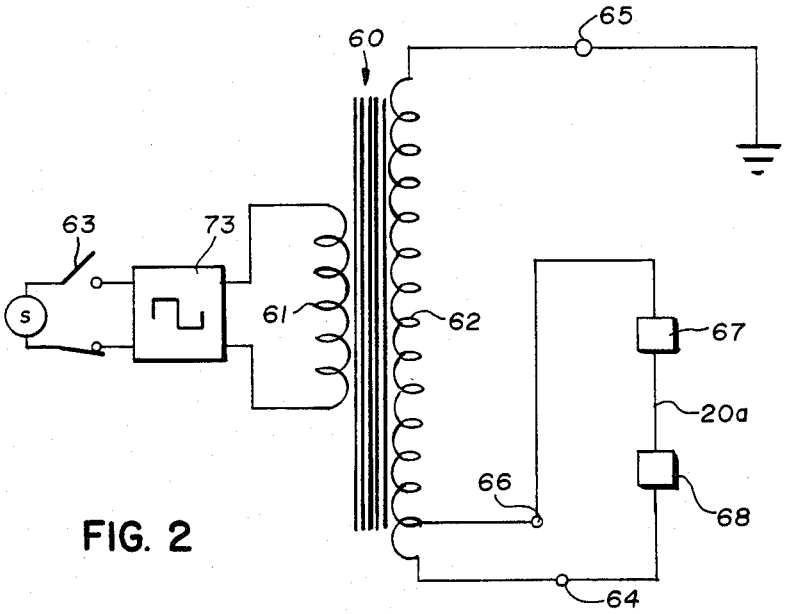
FIG. 2 is an electrical schematic of an improved corona generating apparatus of the invention.

Turning now to FIG. 2, there is shown a schematic representation of apparatus that is made in accordance with a first embodiment of the invention. A transformer 60 includes a primary coil 61 and a secondary coil 62. The primary is suitably coupled to a conventional frequency and wave shaping circuit 73 which provides a desired frequency and wave shape to the input of the transformer 60. The circuit 73 is coupled to a supply of AC electrical power (117 volts or 230 volts, 50 or 60 cycle) upon closing of switch 63. The secondary coil 62 is inductively coupled to the primary coil and produces a high voltage output at terminal 64 of say 4,000 to 8,000 volts. One terminal 68 of a corona current generating electrode 20*a* is connected to terminal 64 thereby placing the electrode at a potential such that a corona current of charge will flow between the electrode and photoconductor 16 which is located in proximity to the electrode. A grid 20*c* (FIG. 1) electrified to a desired electrical potential may be provided between the electrode and the photoconductor to control the level of charge deposited on the photoconductor. Between the high voltage terminal 64 and ground terminal 65 of secondary 62 there is provided an additional terminal 66 that comprises an intermediate tap. A second terminal 67 of electrode 20*a* is coupled to this tap and there is thereby established a small EMF (electromotive force) between the two terminals of the electrode. As there is a small resistance inherent in the electrode, this EMF will cause a resistive heating current to flow through the electrode that will heat the electrode. As noted in U.S. Pat. No. 3,496,352, currents of between 0.4 to 0.9 amps are sufficient to vaporize toner particles when these currents are sustained for only 10 to 30 seconds. In the embodiment shown in FIG. 2, the current is maintained continuously during the charging period and therefore, assuming electrodes of the same resistivity, electrode 20*a* can be heated using lower current levels. With heating of the electrode during the charging process while the electrophotographic apparatus is in a reproduction mode, as opposed to a warm-up mode, any toner particles and perhaps other dust particles depositing on the heated electrode will be annihilated almost immediately and the electrode's charging output will thereby not be impaired during the reproduction process. Apparatus incorporating the invention may also be used to heat the electrode above or below temperatures needed for annihilating toner particles where it is desired, when the apparatus is in the reproduction mode, to heat the wire during corona current generation to improve the uniformity of output charging by thermionic emission from the electrode. The transformer to be used will be selected in accordance with the current demands required and thus will be able to handle both the corona current generating demand as well as the considerably higher electrode heating demand.

As the wire-like electrode is supported between its terminals the wire will tend to expand when heated and an automatic tension adjusting support may be provided similar to that shown in U.S. Pat. No. 3,908,127 to prevent the electrode from sagging. The electrode may also be coated with glass oxides or other known coatings to minimize the adverse effects on the electrode of the corrosive atmosphere created about the electrode. Any unwanted heating of the photoconductor may be prevented by causing cooling air currents to flow across the photoconductor at the corona current charging station. As used herein the term annihilate is used in its general sense and contemplates vaporization and/or oxidation of toner particles to ash as noted in the journal, Research Disclosure, publication No. 20321 published March 1981 at page 119.

Figure 3:
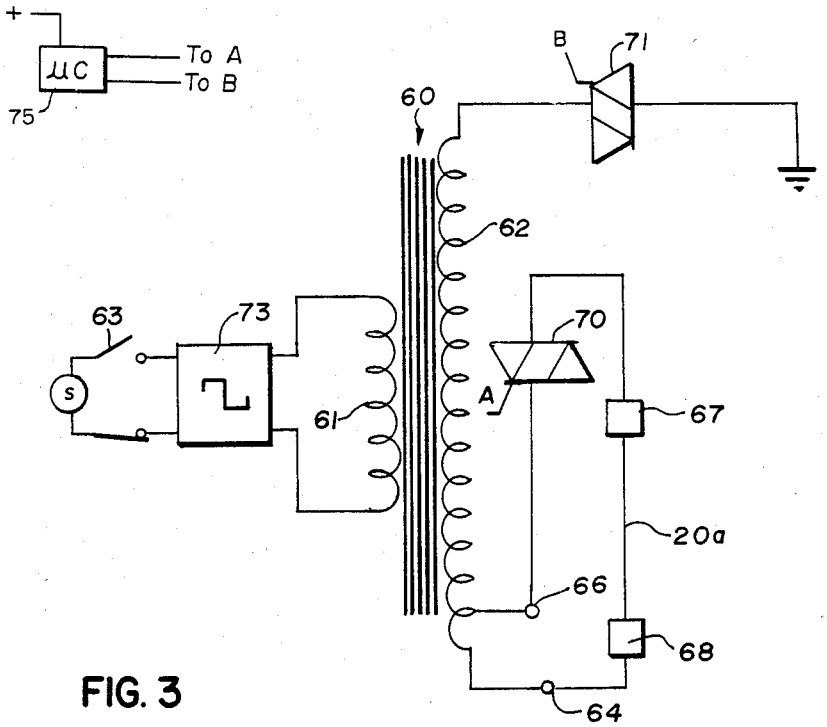
FIG. 3 is an electrical schematic of another embodiment of an improved corona generating apparatus of the invention.

With reference now to FIG. 3 where similar numbers represent elements similar to that shown in FIG. 2 discussion will now be made with regard to elements not found in FIG. 2. In this embodiment control elements are added to control both the timing and duration of the corona current generating circuit and the circuit for heating the electrode. Where it is desirable to extend the useful life of the electrode, the resistive heating current may be controlled by a gate activated switch such as the triac 70 shown. With switch 63 closed the gate terminal A of triac 70 may be enabled by suitably timed signal pulses from the copier apparatus computer 75. With gate B of triac 71 not similarly enabled no corona current can flow through the electrode. Thus during, for example, an initial warm-up period of the copier apparatus the resistive heating current may be applied for a desired period of time controlled by the computer to raise the temperature to a sufficient level for annihilating toner particles which have deposited on the wire. After this cleaning period no further pulses to terminal A will be provided and the triac 70 will cease conducting. The computer will then provide suitably timed pulses to terminal B of the gate of triac 71 to cause the triac to conduct and corona charging current will be generated by electrode 20*a*. By controlling the timing of pulses to terminals A and B the resistive heating of the electrode may be made to occur either when no corona current is being generated or during brief periods when corona current is being generated. Intermediate devices may, of course, be provided between the computer and the gates of the triac. For example, an optoelectronic coupling may be provided between the computer 75 and the gate terminal of triac 70 to isolate electrically the computer from this triac, which is at high electrical potential.

The invention has been described in detail with particular reference to the preferred embodiments thereof, but it will be understood that variation and modification can be affected within the spirit and scope of the invention.

I claim:

1. In an apparatus for generating a corona discharge current, the apparatus including:

an electrode having first and second terminals for producing a corona discharge current when connected to a source of electrical potential that is sufficiently high to cause said electrode to generate a corona discharge current;

a transformer having a pair of output terminals between which a high EMF is generated, means coupling one terminal of the electrode to one of the terminals of the transformer to establish an electrical potential that is sufficiently high to produce a corona discharge current; and the improvement which comprises:

means tapping an intermediate output of the transformer and coupled to the other terminal of the electrode for establishing a relatively small EMF between the ends of the electrode for generating a current through said electrode.

2. The apparatus of claim 1 wherein the electrode comprises a conductor having some electrical resistance and the current through the electrode provides resistive heating of the electrode.

3. In electrographic apparatus having means for forming an electrostatic image on an image receiving member and means for developing such image with marking particles, an improved charger for electrostatically charging the member, prior to formation of the electrostatic image thereon said charger comprising:

an electrode having first and second terminals for producing a corona discharge current when connected to a source of electrical potential that is sufficiently high to cause said electrode to generate a corona discharge current said electrode comprising a conductor having some electrical resistance;

a transformer having a pair of output terminals between which a high EMF is generated, means coupling one terminal of the electrode to one of the terminals of the transformer to establish an electrical potential that is sufficiently high to produce a corona discharge current; and the improvement which comprises:

means tapping an intermediate output of the transformer and coupled to the other terminal of the electrode for establishing a relatively small EMF between the ends of the electrode for generating a current through said electrode; and wherein the current through the electrode heats the electrode to a temperature that is sufficient to annihilate any of said particles which may contaminate the electrode.

4. An apparatus for generating a corona discharge comprising:

an electrode for producing a corona discharge current when impressed with a sufficiently high electrical potential;

a transformer having terminals thereof at different electrical potentials at least one terminal of which is coupled to the electrode for establishing an electrical potential at the electrode that is sufficiently high to produce a corona discharge current; and means electrically coupling the electrode to another of said terminals of the transformer for establishing an inductive EMF across the electrode for generating a non-corona discharge current through said electrode.

5. The apparatus of claim 4 wherein the electrode comprises a conductor having some electrical resistance and the non-corona discharge current generated in said electrode provides resistive heating of the electrode.

6. In an electrophotographic apparatus for forming a developed visible image, comprising:

a photoconductive member;

electrode means for forming a generally uniform electrostatic charge on the photoconductive member by generating corona current from the electrode while the member is in proximity to the electrode;

a transformer having a pair of output terminals between which a high EMF is generated, means coupling one of the terminals of the transformer to the electrode means to produce a corona discharge current;

means for exposing the charged photoconductive member to imaging radiation to form a latent electrostatic image on the photoconductive member;

means for developing the latent electrostatic image by depositing visible materials which adhere selectively to the photoconductive member to form the developed visible image; and the improvement which comprises:

means tapping an intermediate output of the transformer and coupled to the electrode means to produce a heat-generating current through said electrode means.

7. The apparatus of claim 6 and wherein the current through the electrode means heats the electrode means to a temperature that is sufficient to annihilate any of said materials which may contaminate the electrode means.

8. The apparatus of claim 7 wherein the visible materials comprise toner particles which are electrostatically attracted to charged areas of the photoconductive member.

* * * * *